US011266560B2

(12) United States Patent
Xue et al.

(10) Patent No.: US 11,266,560 B2
(45) Date of Patent: Mar. 8, 2022

(54) HAND REHABILITATION DEVICE, REHABILITATION TRAINING DEVICE AND METHOD FOR CONTROLLING THE SAME

(71) Applicants: BOE Technology Group Co., Ltd., Beijing (CN); Beijing BOE Optoelectronics Technology Co., Ltd., Beijing (CN)

(72) Inventors: Bangcan Xue, Beijing (CN); Yanjun Liu, Beijing (CN); Tao Jia, Beijing (CN)

(73) Assignees: BOE Technology Group Co., Ltd., Beijing (CN); Beijing BOE Optoelectronics Technology Co., Ltd., Beijing (CN)

( * ) Notice: Subject to any disclaimer, the term of this patent is extended or adjusted under 35 U.S.C. 154(b) by 636 days.

(21) Appl. No.: 16/234,869

(22) Filed: Dec. 28, 2018

(65) Prior Publication Data

US 2019/0336380 A1 Nov. 7, 2019

(30) Foreign Application Priority Data

May 2, 2018 (CN) ..... 201810409218.0

(51) Int. Cl.
*A61H 1/02* (2006.01)

(52) U.S. Cl.
CPC ... *A61H 1/0288* (2013.01); *A61H 2201/0103* (2013.01); *A61H 2201/1238* (2013.01); *A61H 2201/165* (2013.01); *A61H 2201/1638* (2013.01)

(58) Field of Classification Search
CPC ..... A61H 1/0288; A61H 2201/0103; A61H 2201/1238; A61H 2201/1638; A61H 2201/165; A61H 1/0285; A61H 2201/5056; A61H 2201/0192; A61H 2205/067; A61H 2205/065; A61H 1/00; A61H 1/0218; A61F 5/10
See application file for complete search history.

(56) References Cited

U.S. PATENT DOCUMENTS 3,581,740 A * 6/1971 Sherbourne ..... A61H 1/0288 602/13
2013/0072836 A1* 3/2013 Heaton ..... A61H 23/0263 601/152
2017/0119614 A1* 5/2017 Yeow ..... A61H 1/0285

* cited by examiner

*Primary Examiner* — Quang D Thanh
(74) *Attorney, Agent, or Firm* — Arent Fox LLP; Michael Fainberg

(57) ABSTRACT

A hand rehabilitation device, a rehabilitation training device, and a method for controlling the same are disclosed, and the hand rehabilitation device includes a hand rehabilitation component including: a glove; a hand pneumatic muscle group including at least one finger pneumatic muscle component, wherein a back of each finger sleeve in the glove is installed with at least one of the at least one finger pneumatic muscle component; and a stopper which is connected with each finger sleeve and a side of each of the at least one finger pneumatic muscle component facing a corresponding finger sleeve.

19 Claims, 3 Drawing Sheets

HAND REHABILITATION DEVICE, REHABILITATION TRAINING DEVICE AND METHOD FOR CONTROLLING THE SAME

CROSS-REFERENCE TO RELATED APPLICATION

This Application claims priority to Chinese Patent Application No. 201810409218.0, filed on May 2, 2018, the content of which is incorporated by reference in the entirety.

TECHNICAL FIELD

This disclosure relates to a hand rehabilitation device, a rehabilitation training device, and a method for controlling the same.

DESCRIPTION OF THE RELATED ART

There are a growing number of hemiplegic patients among the elderly, and their general symptom is the stiffness of their hands, and typically characterized in that the hands tend to be bent and gathered together for such a long period of time that muscles of the hands become spasmodic and atrophic, thus seriously discouraging the daily life of the hemiplegic patients.

SUMMARY

Embodiments of the disclosure provide a hand rehabilitation device, a rehabilitation training device, and a method for controlling the same.

In an aspect, the embodiments of the disclosure provide a hand rehabilitation device including a hand rehabilitation component, wherein the hand rehabilitation component includes: a glove; a hand pneumatic muscle group including at least one finger pneumatic muscle component, wherein a back of each finger sleeve in the glove is installed with at least one of the at least one finger pneumatic muscle component; and a stopper which is connected with each finger sleeve and a side of each of the at least one finger pneumatic muscle component facing a corresponding finger sleeve.

In some embodiments, the stopper includes a limit line configured to stop each of the at least one finger pneumatic muscle component from extending in its axial directions, wherein a plurality of knots are formed by the limit line and each finger sleeve.

In some embodiments, the hand rehabilitation component further includes a first control circuit configured to control each of the at least one finger pneumatic muscle component independently.

In some embodiments, the hand rehabilitation device further includes a wrist rehabilitation component including: a forearm sleeve connected with the glove; a wrist pneumatic muscle group which is contractile and arranged around the forearm sleeve, wherein the wrist pneumatic muscle group includes a plurality of wrist pneumatic muscle components; a bracket configured to fix the wrist pneumatic muscle group in position; and a second control circuit configured to control each of the plurality of wrist pneumatic muscle components to control a state of the wrist pneumatic muscle group.

In some embodiments, the wrist pneumatic muscle group includes a first wrist pneumatic muscle component, a second wrist pneumatic muscle component, a third wrist pneumatic muscle component, and a fourth wrist pneumatic muscle component, wherein the first wrist pneumatic muscle component and the second wrist pneumatic muscle component lie in a first plane, the second wrist pneumatic muscle component and the third wrist pneumatic muscle component lie in a second plane, the third wrist pneumatic muscle component and the fourth wrist pneumatic muscle component lie in a third plane, and the fourth wrist pneumatic muscle component and the first wrist pneumatic muscle component lie in a fourth plane, the first plane is parallel to the third plane, and the second plane is parallel to the fourth plane, and wrist pneumatic muscle components in the first plane, and wrist pneumatic muscle components in the third plane form an antagonism mechanism, and wrist pneumatic muscle components in the second plane, and wrist pneumatic muscle components in the fourth plane form an antagonism mechanism.

In some embodiments, the bracket includes an annular first bracket and an annular second bracket arranged opposite to each other, and an annular forearm sheath arranged in the second bracket to fix the forearm sleeve in position, wherein: the forearm sheath is adjustable in a radial direction of the second bracket, and two ends of each wrist pneumatic muscle component are fixed respectively on the first bracket and the second bracket.

In some embodiments, the forearm sheath is connected with the second bracket through a plurality of springs.

In some embodiments, the bracket includes an annular first bracket and an annular second bracket arranged opposite to each other, and an annular forearm sheath arranged in the second bracket to fix the forearm sleeve in position, wherein: a diameter of the forearm sheath is adjustable, and two ends of each wrist pneumatic muscle component are fixed respectively on the first bracket and the second bracket.

In some embodiments, the hand rehabilitation device further includes a fixing component, where the fixing component includes a fixing stand arranged on a palm section of the glove, a bottom fixing bracket arranged on a side of the fixing stand facing away from the palm section, and a side fixing bracket arranged on a side of the fixing stand; and the hand rehabilitation device is removably connected with the first bracket through the bottom fixing bracket and the side fixing bracket.

In some embodiments, each pneumatic muscle component includes a flexible tube, and a woven mesh located on an outer side of the flexible tube, wherein: in each finger pneumatic muscle component, an angle between a fiber direction of the woven mesh located on the outer side of the flexible tube, and an axial direction of the flexible tube is greater than 57.4°.

In some embodiments, each pneumatic muscle component includes a flexible tube, and a woven mesh located on an outer side of the flexible tube, wherein: in each wrist pneumatic muscle component, an angle between a fiber direction of the woven mesh located on the outer side of the flexible tube 3, and an axial direction of the flexible tube is less than 57.4°.

In another aspect, the embodiments of the disclosure further provide a rehabilitation training device including a hand rehabilitation device, wherein the hand rehabilitation device includes a hand rehabilitation component including: a glove; a hand pneumatic muscle group including at least one finger pneumatic muscle component, wherein a back of each finger sleeve in the glove is installed with at least one of the at least one finger pneumatic muscle component; and a stopper which is connected with each finger sleeve and a side of each of the at least one finger pneumatic muscle component facing a corresponding finger sleeve.

In some embodiments, the stopper includes a limit line configured to stop each of the at least one finger pneumatic muscle component from extending in its axial directions, wherein a plurality of knots are formed by the limit line and each finger sleeve.

In some embodiments, the hand rehabilitation component further includes a first control circuit configured to control each of the at least one finger pneumatic muscle component independently.

In some embodiments, the hand rehabilitation device further includes a wrist rehabilitation component including: a forearm sleeve connected with the glove; a wrist pneumatic muscle group which is contractile and arranged around the forearm sleeve, wherein the wrist pneumatic muscle group includes a plurality of wrist pneumatic muscle components; a bracket configured to fix the wrist pneumatic muscle group in position; and a second control circuit configured to control each of the plurality of wrist pneumatic muscle components to control a state of the wrist pneumatic muscle group.

In some embodiments, the wrist pneumatic muscle group includes a first wrist pneumatic muscle component, a second wrist pneumatic muscle component, a third wrist pneumatic muscle component, and a fourth wrist pneumatic muscle component, wherein the first wrist pneumatic muscle component and the second wrist pneumatic muscle component lie in a first plane, the second wrist pneumatic muscle component and the third wrist pneumatic muscle component lie in a second plane, the third wrist pneumatic muscle component and the fourth wrist pneumatic muscle component lie in a third plane, and the fourth wrist pneumatic muscle component and the first wrist pneumatic muscle component lie in a fourth plane, the first plane is parallel to the third plane, and the second plane is parallel to the fourth plane, and wrist pneumatic muscle components in the first plane, and wrist pneumatic muscle components in the third plane form an antagonism mechanism, and wrist pneumatic muscle components in the second plane, and wrist pneumatic muscle components in the fourth plane form an antagonism mechanism.

In some embodiments, the bracket includes an annular first bracket and an annular second bracket arranged opposite to each other, and an annular forearm sheath arranged in the second bracket to fix the forearm sleeve in position, wherein: the forearm sheath is adjustable in a radial direction of the second bracket, and two ends of each wrist pneumatic muscle component are fixed respectively on the first bracket and the second bracket.

In some embodiments, the bracket includes an annular first bracket and an annular second bracket arranged opposite to each other, and an annular forearm sheath arranged in the second bracket to fix the forearm sleeve in position, wherein: a diameter of the forearm sheath is adjustable, and two ends of each wrist pneumatic muscle component are fixed respectively on the first bracket and the second bracket.

In some embodiments, the forearm sheath is connected with the second bracket through a plurality of springs.

In some embodiments, the hand rehabilitation device further includes a fixing component, where the fixing component includes a fixing stand arranged on a palm section of the glove, a bottom fixing bracket arranged on a side of the fixing stand facing away from the palm section, and a side fixing bracket arranged on a side of the fixing stand; and the hand rehabilitation device is removably connected with the first bracket through the bottom fixing bracket and the side fixing bracket.

In some embodiments, each pneumatic muscle component includes a flexible tube, and a woven mesh located on an outer side of the flexible tube, wherein: in each finger pneumatic muscle component, an angle between a fiber direction of the woven mesh located on the outer side of the flexible tube, and an axial direction of the flexible tube is greater than 57.4°.

In some embodiments, each pneumatic muscle component includes a flexible tube, and a woven mesh located on an outer side of the flexible tube, wherein: in each wrist pneumatic muscle component, an angle between a fiber direction of the woven mesh located on the outer side of the flexible tube 3, and an axial direction of the flexible tube is less than 57.4°.

In still another aspect, the embodiments of the disclosure further provide a method for controlling the rehabilitation training device according to the embodiments of the disclosure, the method including: inflate a finger pneumatic muscle component in the hand pneumatic muscle group so that the finger pneumatic muscle component control a corresponding finger sleeve to be bent; and/or, deflate a finger pneumatic muscle component in the hand pneumatic muscle group so that a corresponding finger sleeve stretches straightly.

In some embodiments, when the hand rehabilitation device further includes a wrist rehabilitation component, the method includes an operation of controlling an action of the hand rehabilitation component and an operation of controlling an action of the wrist rehabilitation component; wherein in the operation of controlling the action of the hand rehabilitation component: inflate a finger pneumatic muscle component in the hand pneumatic muscle group so that the finger pneumatic muscle component control a corresponding finger sleeve to be bent, and/or, deflate a finger pneumatic muscle component in the hand pneumatic muscle group so that a corresponding finger sleeve stretches straightly; wherein in the operation of controlling the action of the hand rehabilitation component: inflate a first wrist pneumatic muscle component and a second wrist pneumatic muscle component in a first plane, and deflate a third wrist pneumatic muscle component and a fourth wrist pneumatic muscle component in a third plane to control a wrist to move into the first plane; or deflate a first wrist pneumatic muscle component and a second wrist pneumatic muscle component in a first plane, and inflate a third wrist pneumatic muscle component and a fourth wrist pneumatic muscle component in a third plane to control a wrist to move into the third plane; or inflate a first wrist pneumatic muscle component and a fourth wrist pneumatic muscle component in a fourth plane, and deflate a second wrist pneumatic muscle component and a third wrist pneumatic muscle component in a second plane to control a wrist to move into the fourth plane; or deflate a first wrist pneumatic muscle component and a fourth wrist pneumatic muscle component in a fourth plane, and inflate a second wrist pneumatic muscle component and a third wrist pneumatic muscle component in a second plane to control a wrist to move into the second plane.

BRIEF DESCRIPTION OF THE DRAWINGS

In order to make the technical solutions according to the embodiments of the disclosure more apparent, the drawings to which a description of the embodiments refers will be briefly introduced below, and apparently the drawings to be described below are merely illustrative of some of the embodiments of the disclosure, and those ordinarily skilled in the art can derive from these drawings other drawings without any inventive effort.

DETAILED DESCRIPTION OF THE EMBODIMENTS

The technical solutions according to the embodiments of the disclosure will be described below clearly and fully with reference to the drawings in the embodiments of the disclosure, and apparently the embodiments to be described are only a part but not all of the embodiments of the disclosure. Based upon the embodiments here of the disclosure, all the other embodiments which can occur to those ordinarily skilled in the art without any inventive effort shall fall into the claimed scope of the disclosure.

In the art known to the inventors, hands of hemiplegic patients are generally rehabilitated through manually personal massage training, so the intensity and efficiency of rehabilitation training cannot be well guaranteed, but also the burden on a medical worker has been aggravated.

The inventors realize that a pneumatic muscle (also called a pneumatic artificial muscle) expands radially and contracts axially while being inflated, and an external load is driven by an axial driving force generated as a result of axial contraction of the pneumatic muscle. As there is a growing pressure inside the pneumatic muscle, the rigidity thereof increases; and as there is a dropping pressure inside the pneumatic muscle, the rigidity thereof decreases.

The pneumatic muscle with this characteristic can be used as a linear driver, and as compared with a traditional hydraulic cylinder, pneumatic cylinder, motor, or another driver, the pneumatic muscle is very light-weighted; and a length of the pneumatic muscle can be designed as needed for a driving stroke dependent upon the contractility of the pneumatic muscle, so that a risk beyond the stroke can be avoided, the cost of the pneumatic muscle can be very low; and additionally, the pneumatic muscle has high compliance and safety, thus can be applied in the field of medical rehabilitation.

Figure 1:
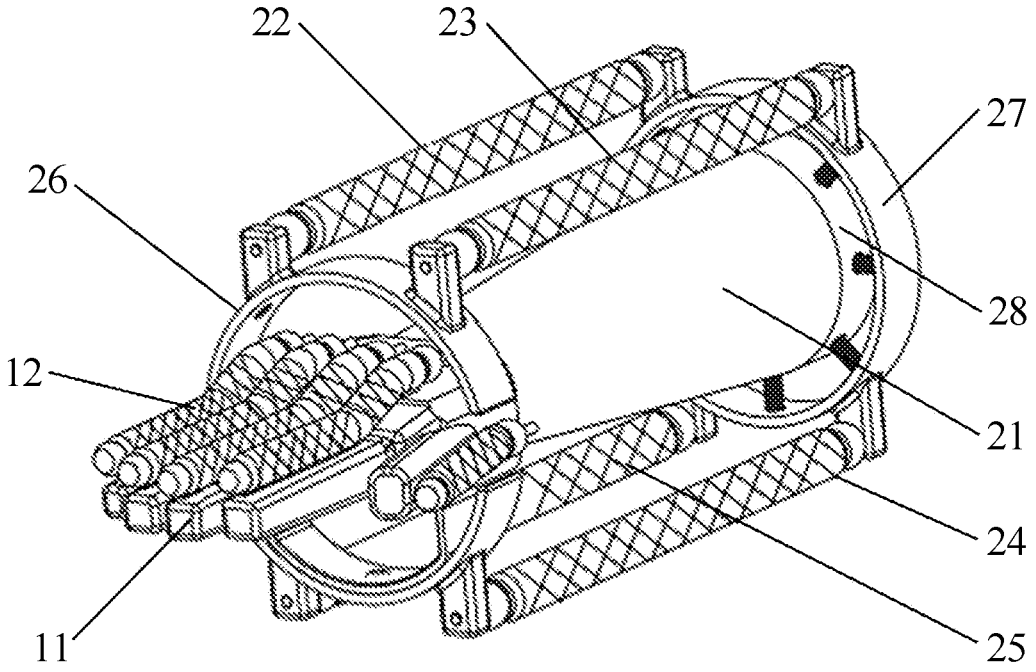
FIG. 1 is a schematic structural diagram of a hand rehabilitation device according to the embodiments of the disclosure in a front view.

Accordingly, as illustrated in FIG. 1, the embodiments of the disclosure provide a hand rehabilitation device including a hand rehabilitation component, where the hand rehabilitation component includes: a glove 11 including at least one finger sleeve, wearable by a user; a hand pneumatic muscle group including at least one finger pneumatic muscle component 12, where a back of each finger sleeve in the glove 11 is installed with at least one of the at least one finger pneumatic muscle component 12; and a stopper connected with each finger sleeve and a side of each of the at least one finger pneumatic muscle component 12 facing a corresponding finger sleeve.

The hand rehabilitation device according to the embodiments of the disclosure includes the hand rehabilitation component including the glove 11 and the hand pneumatic muscle group, and the hand pneumatic muscle group further includes at least one finger pneumatic muscle component 12. In order to operate on the hand pneumatic muscle group according to the embodiments of the disclosure, a user wears the glove 11, and while the hand pneumatic muscle group is being inflated, since the stopper is connected with each finger sleeve and the side of each of the at least one finger pneumatic muscle component 12 facing a corresponding finger sleeve, for each finger pneumatic muscle component 12, the stopper can stop a side of the finger pneumatic muscle component 12 facing a finger sleeve from extending axially, so that while the finger pneumatic muscle component 12 is being inflated, the side thereof facing the finger sleeve cannot extend axially, so the finger pneumatic muscle component 12 is being bent toward the glove 11 to bring a finger in the finger sleeve connected therewith into being bent; and while the hand pneumatic muscle group is being deflated, each finger pneumatic muscle component 12 is being restored so that the fingers of the user can be restored from being bent into being straight.

The hand rehabilitation device according to the embodiments of the disclosure can change a linear motion of each pneumatic muscle component into a bending motion, and as there is a growing pressure inside each pneumatic muscle component, its rigidity and bending force are increasing, so that a corresponding finger of the user can be driven into being bent.

Accordingly, the hand rehabilitation device according to the embodiments of the disclosure has such a wearable structure that is simple in structure, and low-weighted, and which has high safety, compliance and adaptability, thus facilitating daily rehabilitation training of a patient.

In some embodiments, the stopper is non-extensible, i.e. the stopper is a rigid component.

In some embodiments, each finger pneumatic muscle component 12 is able to bring a finger sleeve connected therewith into being bent, so that each finger pneumatic muscle component 12 can bring a finger in a finger sleeve connected therewith into being bent.

In some embodiments, each finger pneumatic muscle component 12 is an extensible pneumatic muscle which is able to extend along its axial direction.

While a finger pneumatic muscle component 12 is being inflated and extending, a side of the finger pneumatic muscle component 12 facing a finger sleeve is fixed by the stopper, and cannot extend axially, so the finger pneumatic muscle component 12 is being bent toward the glove 11 instead of moving linearly to thereby bring a finger in the finger sleeve connected therewith into being bent; and while the hand pneumatic muscle group is being deflated, each finger pneumatic muscle component 12 is being restored so that the fingers of the user can be restored from being bent into being straight.

Figure 2:
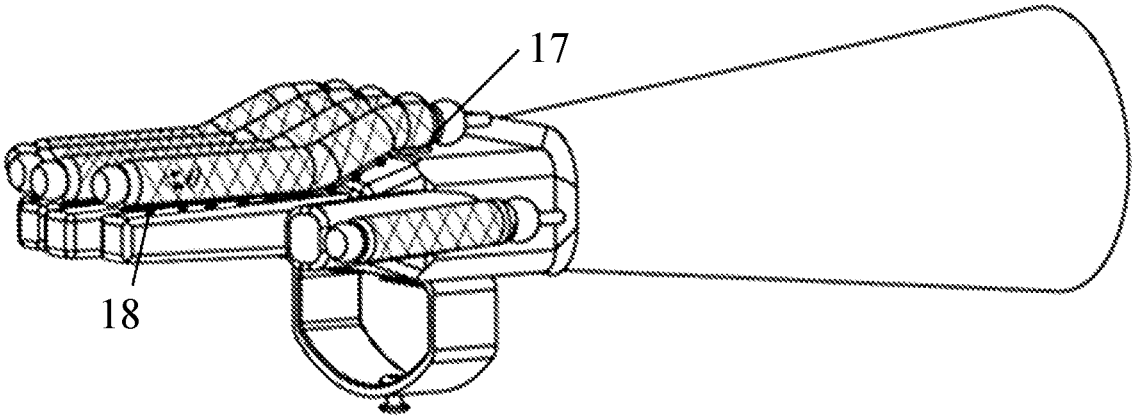
FIG. 2 is a schematic structural diagram of a hand rehabilitation component according to the embodiments of the disclosure.

In some embodiments, as illustrated in FIG. 2, the stopper includes a limit line 17 configured to stop each of the at least one finger pneumatic muscle component 12 from extending in its axial direction, where a plurality of knots 18 are formed by the limit line 17 and each finger sleeve.

In some embodiments, the limit line 17 is a thin thread made of a metal or a tensile fiber.

In some embodiments, the plurality of knots 18 are connected with the side of each of the at least one finger pneumatic muscle component 12 facing a corresponding finger sleeve, the limit line 17, and each finger sleeve, and the plurality of knots 18 are arranged in an extension direction of each finger sleeve.

Since each finger pneumatic muscle component 12 can extend along its axial direction, each finger pneumatic muscle component 12 is extending linearly in its axial direction while being inflated, and such an insignificant axial pushing force is generated that the finger pneumatic muscle component will not be bent. While in the hand rehabilitation device according to the embodiments of the disclosure, the limit line 17 which is not extensible and highly strong is arranged on a side of each finger pneumatic muscle component 12 proximate to a finger sleeve, and a plurality of fixing knots 18, formed by the limit line 17, are arranged uniformly on a surface of the limit line 17, each finger pneumatic muscle component 12 and each finger sleeve to fix the limit line 17, each finger pneumatic muscle component 12 and each finger sleeve together so as to stop each finger pneumatic muscle component 12 from extending axially to a finger sleeve side, so that while a finger pneumatic muscle component 12 is being inflated and extending, the finger pneumatic muscle component 12 cannot extend on that side, and thus is being bent toward that side instead of moving linearly, and as there is a growing pressure inside the finger pneumatic muscle component, the rigidity and bending force thereof are increasing, so that a corresponding finger of the user is driven into being bent; and while the finger pneumatic muscle component is being deflated, it is being restored so that the corresponding finger of the user can become straight again.

In some embodiments, in the hand rehabilitation device according to the embodiments of the disclosure, the hand rehabilitation component further includes a first control circuit.

In some embodiments, the first control circuit is configured to control each finger pneumatic muscle component 12 independently to train and rehabilitate respective fingers of a palm differently to thereby facilitate rehabilitation of a patient better and faster.

In order to better train and rehabilitate a wrist of a patient, as illustrated in FIG. 1, the hand rehabilitation device according to the embodiments of the disclosure further includes a wrist rehabilitation component including following components.

A forearm sleeve 21 connected with the glove 11; a wrist pneumatic muscle group which is contractile and arranged around the forearm sleeve 21, where the wrist pneumatic muscle group includes a plurality of wrist pneumatic muscle components; a bracket configured to fix the wrist pneumatic muscle group in position; and a second control circuit configured to control a state of the wrist pneumatic muscle group, where the second control circuit is configured to control each of the plurality of wrist pneumatic muscle components to control the state of the wrist pneumatic muscle group.

In some embodiments, the wrist pneumatic muscle group includes a first wrist pneumatic muscle component 22, a second wrist pneumatic muscle component 23, a third wrist pneumatic muscle component 24, and a fourth wrist pneumatic muscle component 25; where the first wrist pneumatic muscle component 22 and the second wrist pneumatic muscle component 23 lie in a first plane, the second wrist pneumatic muscle component 23 and the third wrist pneumatic muscle component 24 lie in a second plane, the third wrist pneumatic muscle component 24 and the fourth wrist pneumatic muscle component 25 lie in a third plane, and the fourth wrist pneumatic muscle component 25 and the first wrist pneumatic muscle component 22 lie in a fourth plane; the first plane is parallel to the third plane, and the second plane is parallel to the fourth plane; and wrist pneumatic muscle components in the first plane and wrist pneumatic muscle components in the third plane form an antagonism mechanism, and wrist pneumatic muscle components in the second plane and wrist pneumatic muscle components in the fourth plane form an antagonism mechanism.

In some embodiments, a side of the glove 11 connected with the forearm sleeve 21 can be sewed uniformly together using a needle and a thread (such as a thread made of a fiber).

For the sake of a convenient description below of the principle, directions are defined as follows: an arm of a human body is stretched straightly, and a palm is facing the ground, so for the straightly stretched arm and the palm, if they are bent toward the ground, then they may be bent downward; if they are bent in the opposite direction, then they may be bent upward; if they are bent toward the outer side of the human body, then they may be bent rightward; and if they are bent toward the inner side of the human body, then they may be bent leftward. Bending upward or downward, and bending leftward or rightward refers to movement directions of the wrist of the human body in two dimensions.

Firstly, the four wrist pneumatic muscle components are pre-inflated by inflating the same amount of gas at a low pressure into them so that the four wrist pneumatic muscle components have the same low contractile force, thus the wrist pneumatic muscle components stretched straightly from their flexible state, and the wrist remains straight.

Next, while the first wrist pneumatic muscle component 22 and the second wrist pneumatic muscle component 23 in the first plane are being further inflated and pressurized, the first wrist pneumatic muscle component 22 and the second wrist pneumatic muscle component 23 are further contracting axially, thus resulting in a high contractile force; and in the meanwhile, the third wrist pneumatic muscle component 24 and the fourth wrist pneumatic muscle component 25 in the third plane are being deflated and depressurized, and after the third wrist pneumatic muscle component 24 and the fourth wrist pneumatic muscle component 25 are deflated and depressurized, their contractile force is lower than the contractile force of the first wrist pneumatic muscle component 22 and the second wrist pneumatic muscle component 23, so that they are elongated due to the antagonism mechanism, and thus the wrist can be bent upward.

Or, while the first wrist pneumatic muscle component 22 and the second wrist pneumatic muscle component 23 in the first plane are being further deflated and depressurized, and the third wrist pneumatic muscle component 24 and the fourth wrist pneumatic muscle component 25 in the third plane are being further inflated and pressurized, the third wrist pneumatic muscle component 24 and the fourth wrist pneumatic muscle component 25 are further contracting axially, so their contractile force is higher than the contractile force of the first wrist pneumatic muscle component 22 and the second wrist pneumatic muscle component 23, so that the first wrist pneumatic muscle component 22 and the second wrist pneumatic muscle component 23 are elongated due to the antagonism mechanism, and thus the wrist can be bent downward.

Or, while the first wrist pneumatic muscle component 22 and the fourth wrist pneumatic muscle component 25 in the fourth plane are being further inflated and pressurized, and the second wrist pneumatic muscle component 23 and the third wrist pneumatic muscle component 24 in the second plane are being further deflated and depressurized, the first wrist pneumatic muscle component 22 and the fourth wrist pneumatic muscle component 25 are further contracting axially, so their contractile force is higher than the axially-driving force of the second wrist pneumatic muscle component 23 and the third wrist pneumatic muscle component 24, so that the second wrist pneumatic muscle component 23 and the third wrist pneumatic muscle component 24 are elongated due to the antagonism mechanism, and thus the wrist can be bent rightward.

Or, while the first wrist pneumatic muscle component 22 and the fourth wrist pneumatic muscle component 25 in the fourth plane are deflated and depressurized, and the second wrist pneumatic muscle component 23 and the third wrist pneumatic muscle component 24 in the second plane are being inflated and pressurized, the second wrist pneumatic muscle component 23 and the third wrist pneumatic muscle component 24 in the second plane are further contracting axially, so their contractile force is higher than the axially-driving force of the first wrist pneumatic muscle component 22 and the fourth wrist pneumatic muscle component 25, so that the first wrist pneumatic muscle component 22 and the fourth wrist pneumatic muscle component 25 are elongated due to the antagonism mechanism, and thus the wrist can be bent leftward.

The hand rehabilitation device according to the embodiments of the disclosure include a large number of flexible components and flexible drivers, and is very low-weighted and highly compliant to hands and wrists of a human body, so it can be applicable to functional training of wrists of hemiplegic patients, and rehabilitation therapies of patents with wrist joint illnesses and sporting injuries, can be widely applicable in the field of rehabilitation services at home due to the low cost thereof.

In some embodiments, as illustrated in FIG. 1, the bracket includes an annular first bracket 26 and an annular second bracket 27 arranged opposite to each other, and an annular forearm sheath 28 arranged in the second bracket 27 to fix the forearm sleeve 21 in position, where: the forearm sheath 28 is adjustable in a radial direction of the second bracket 27, and two ends of each wrist pneumatic muscle component are fixed respectively on the first bracket 26 and the second bracket 27.

Figure 3:
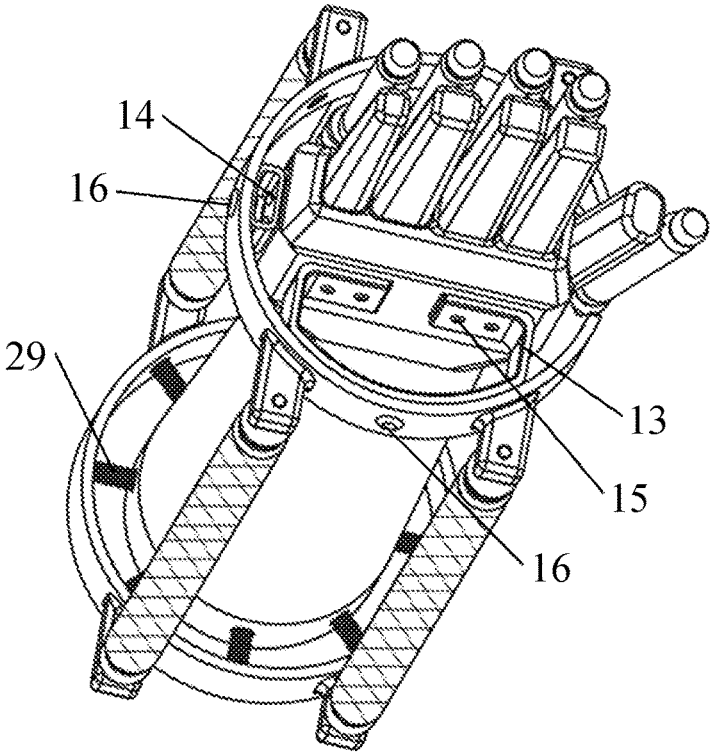
FIG. 3 is a schematic structural diagram of a hand rehabilitation device according to the embodiments of the disclosure in a back view.

In some embodiments, as illustrated in FIG. 3, the forearm sheath 28 is connected with the second bracket 27 through a plurality of springs 29.

In some embodiments, the plurality of springs 29 are arranged uniformly on a circumference of the forearm sheath 28.

The forearm sheath 28 is fixed together with the second bracket 27 through the springs 29 distributed uniformly on the circumference thereof, and the springs 29 are contractible so that the position of the forearm sheath 28 in the radial direction of the second bracket 27 can be adjusted according to the need of the wearer wearing the hand rehabilitation device to thereby improve the comfort of the wearer wearing the hand rehabilitation device.

In some embodiments, the bracket includes an annular first bracket 26 and an annular second bracket 27 arranged opposite to each other, and an annular forearm sheath 28 arranged in the second bracket 27 to fix the forearm sleeve 21 in position, where: a diameter of the forearm sheath 28 is adjustable, and two ends of each wrist pneumatic muscle component are fixed respectively on the first bracket 26 and the second bracket 27.

In the structure above, the forearm sheath 28 with some flexibility, elasticity, and rigidness can be adhered firmly on the arm of the wearer, and the forearm sheath 28 can be extensible slightly in a circumferential direction dependent upon the arm of the wearer to thereby improve the comfort of the wearer wearing the hand rehabilitation device.

In some embodiments, as illustrated in FIG. 3, the hand rehabilitation device further includes a fixing component including a fixing stand arranged on a palm section of the glove 11, a bottom fixing bracket 13 arranged on a side of the fixing stand facing away from the palm section, and a side fixing bracket 14 arranged on a side of the fixing stand; and the hand rehabilitation device is removably connected with the first bracket 26 through the bottom fixing bracket 13 and the side fixing bracket 14.

For example, the bottom fixing bracket 13 and the side fixing bracket 14 are connected with the fixing stand through rivets 15; and the bottom fixing bracket 13 and the side fixing bracket 14 are removably connected with the first bracket 26 through lock screws 16.

Figure 4:
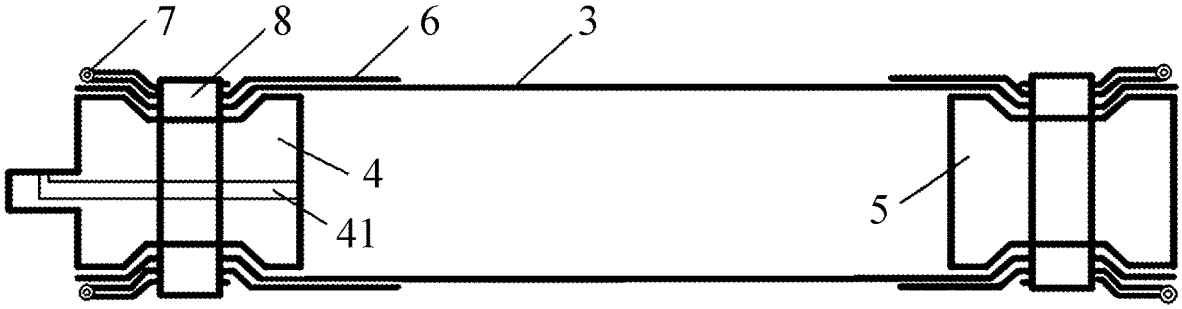
FIG. 4 is a schematic structural diagram of a pneumatic muscle component according to the embodiments of the disclosure.

In some embodiments, as illustrated in FIG. 4, each pneumatic muscle component includes a flexible tube 3 (such as a rubber tube), and a woven mesh 6 (such as a PET fiber woven mesh) located on an outer side of the flexible tube 3. For example, each finger pneumatic muscle component 12 includes a flexible tube 3 and a woven mesh 6 located on an outer side of the flexible tube 3, and an angle between a fiber direction of the woven mesh 6 located on the outer side of the flexible tube 3, and an axial direction of the flexible tube 3 is greater than 57.4°.

For another example, each wrist pneumatic muscle component includes a flexible tube 3 and a woven mesh 6 located on an outer side of the flexible tube 3, and an angle between a fiber direction of the woven mesh 6 located on the outer side of the flexible tube 3, and an axial direction of the flexible tube 3 is less than 57.4°.

When the angle between the fiber direction of the woven mesh 6 located on the outer side of the flexible tube 3, and the axial direction of the flexible tube 3 is less than 57.4°, the pneumatic muscle component contracting axially after being inflated generates a pulling force while being inflated and contracting, to thereby drive an external load; and when the angle between the fiber direction of the woven mesh 6 located on the outer side of the flexible tube 3, and the axial direction of the flexible tube 3 is greater than 57.4°, the extensible pneumatic muscle component extending axially after being inflated generates an axial pushing force while being inflated and extending, to thereby drive an external load.

In some embodiments, as illustrated in FIG. 4, each pneumatic muscle component includes following components.

A flexible tube 3 inside which a first plug 4 and a second plug 5 are arranged respectively, where recesses with openings facing an inside wall of the flexible tube 3 are arranged on circumferential sides of the first plug 4 and the second plug 5, and the first plug 4 includes a gas channel 41 through which gas enters and exits.

A woven mesh 6 enwrapping an outer side of the flexible tube 3, where the woven mesh 6 includes a woven mesh body, and bended portions located on two sides of the woven mesh body, where each bended portion is located on a side of the woven mesh body facing away from the flexible tube 3, and an end of each bended portion is located on a foot section of a side of a plug facing an inner side of the flexible tube 3.

A locking line 7 located between the woven mesh body and each bended portion; and a first clamp 8 configured to clamp the woven mesh 6, the flexible tube 3, and the first plug 4 at a corresponding recess, and a second clamp (not illustrated) configured to clamp the woven mesh 6, the flexible tube 3, and the second plug 5 at a corresponding recess.

In some embodiments, each pneumatic muscle component can be fabricated by winding the flexible tube 3 and the woven mesh 6 with a black tape in two or three turns respectively at the recesses of the first plug 4 and the second plug 5, so that the flexible tube 3 is adhered firmly with the woven mesh 6 at the recesses of the plugs; next, winding edges of the recesses of the plugs with the locking line 7 in one turn to prevent the woven mesh 6 from falling off the pneumatic muscle component being inflated at a high pressure; and thereafter, folding the bended portions of the woven mesh 6, arranging the locking line 7 between the woven mesh 6 body and the bended portions, and fixing them at the recesses of the plugs using the first clamp 8 and the second clamp, so that on one hand, gas can be prevented from being leaked out of the pneumatic muscle component, and on the other hand, the pneumatic muscle component can be prevented from being burst while being inflated at a high pressure.

In the embodiments of the disclosure, the first plug 4 and the second plug 5 can be designed flexibly so that they can be connected as needed in different patterns; and the flexible tube 3 shall have some flexibility and elasticity so that it can expand and contract while being inflated and deflated, and the flexible tube 3 shall have a good anti-fatigue characteristic, e.g., a rubber hose; the woven mesh 6 shall be highly extensible, strong and flexible; a material of the first plug 4 and the second plug 5 can be a highly compact rigid non-metallic material, or a highly strong metal material with a low density; and the first clamp 8 and the second clamp can be stainless steel clamp pieces, or aluminum alloy pieces.

Figure 5:
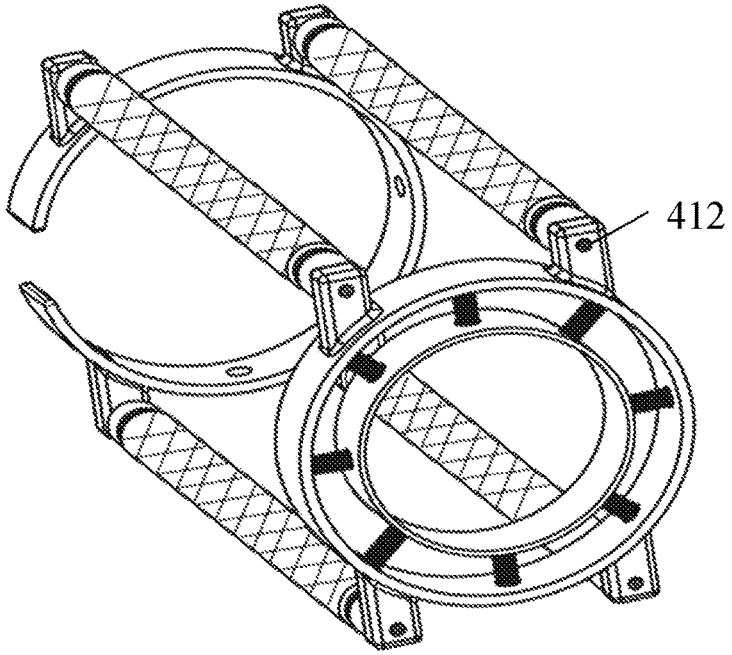
FIG. 5 is a schematic structural diagram of a wrist rehabilitation component according to the embodiments of the disclosure.

In some embodiments, a position of an inflation opening 412 of the gas channel 41 of the first plug 4 in each wrist pneumatic muscle component is as illustrated in FIG. 5.

In some embodiments, the hand rehabilitation device further includes a general control circuit including a first control circuit and a second control circuit. The general control circuit can control the hand pneumatic muscle group 1 and the wrist pneumatic muscle group 2 as illustrated in FIG. 6.

In the embodiments of the disclosure, an electrical device used in a control circuit, such as a controller can be a general processor like a Central Processing Unit (CPU), a Micro Controller Unit (MCU), or a Digital Signal Processor (DSP), etc.; or can be an arithmetic logic processor, such as an Application Specific Integrated Circuit (ASIC) or a Field Programmable Gate Array, which is designed to perform corresponding functions.

Figure 6:
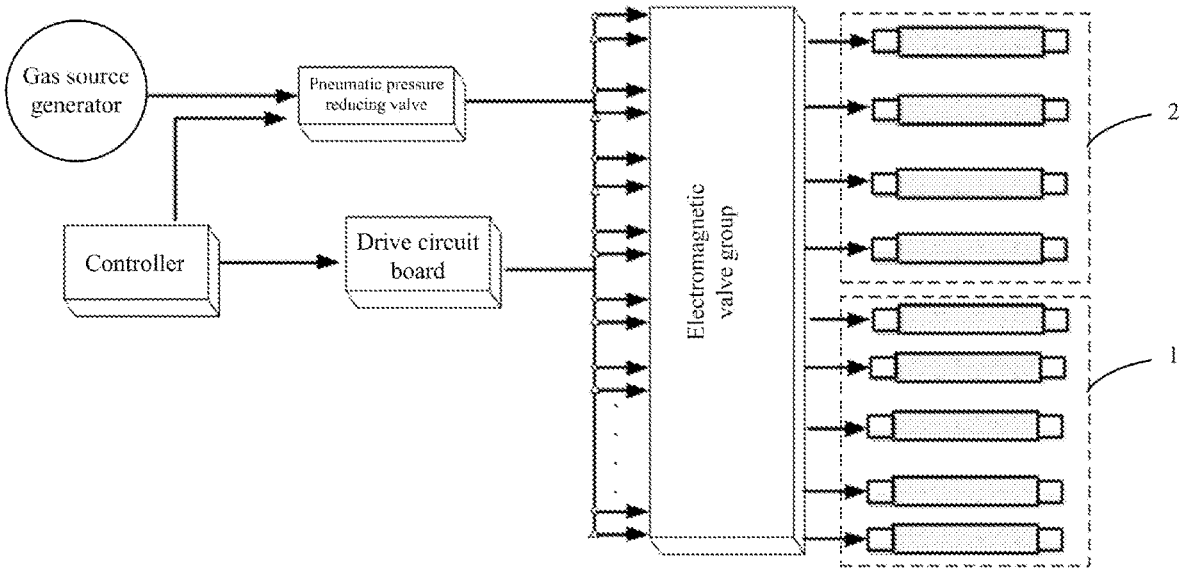
FIG. 6 is a principle diagram of a general control circuit according to the embodiments of the disclosure.

In some embodiments, as illustrated in FIG. 6, the general control circuit further includes a controller configured to generate a control signal for each pneumatic muscle component, a drive circuit board configured to receive the control signal, and an electromagnetic valve group configured to inflate and deflate respective pneumatic muscle components, where the general control circuit is connected with a gas source generator configured to generate gas, and the gas source generator is connected with an input terminal of the electromagnetic valve group, an output terminal of the electromagnetic valve group is connected with each pneumatic muscle component, a signal input terminal of the electromagnetic valve group is connected with the drive circuit board, and the drive circuit board is signal-connected with the controller.

In the embodiments of the disclosure, the gas source generator can generate and store a sufficient gas source in a gas storage device, and can set the highest pressure of the gas source so that the gas source generator can be automatically started into and stopped from supplementing the gas.

In some embodiments, the electromagnetic valve group is configured to be controlled to control a state of each pneumatic muscle component, where the state of each pneumatic muscle component includes an inflated state, a deflated state, or a holding state.

Where components of the electromagnetic valve group can be arranged as needed.

For example, two two-way sub-electromagnetic valves are configured to control one of the pneumatic muscle components.

For another example, a three-way sub-electromagnetic valve is configured to control one of the pneumatic muscle components.

In some embodiments, the general control circuit further includes a pneumatic pressure reducing valve, arranged between the gas source generator and the input terminal of the electromagnetic valve group, to adjust a pressure of the gas coming out of the gas source generator to an operating pressure of the hand rehabilitation device.

Based upon the same inventive concept, the embodiments of the disclosure further provide a rehabilitation training device including the hand rehabilitation device according to any one of the embodiments above of the disclosure. Since the rehabilitation training device addresses the problem under a similar principle to the hand rehabilitation device, reference can be made to the implementation of the hand rehabilitation device for an implementation of the rehabilitation training device, so a repeated description thereof will be omitted here.

Based upon the same inventive concept, the embodiments of the disclosure further provide a method for controlling the rehabilitation training device according to any one of the embodiments above of the disclosure, where the method includes controlling the hand rehabilitation component to: inflate a finger pneumatic muscle component 12 in the hand pneumatic muscle group so that the finger pneumatic muscle component 12 control a corresponding finger sleeve to be bent; and/or, deflate a finger pneumatic muscle component 12 in the hand pneumatic muscle group so that a corresponding finger sleeve stretches straightly.

In some embodiments, when the hand rehabilitation device further includes a wrist rehabilitation component, the method further includes controlling the wrist rehabilitation component to: inflate a first wrist pneumatic muscle component 22 and a second wrist pneumatic muscle component 23 in a first plane, and deflate a third wrist pneumatic muscle component 24 and a fourth wrist pneumatic muscle component 25 in a third plane to control a wrist to move into the first plane; or deflate a first wrist pneumatic muscle component 22 and a second wrist pneumatic muscle component 23 in a first plane, and inflate a third wrist pneumatic muscle component 24 and a fourth wrist pneumatic muscle component 25 in a third plane to control a wrist to move into the third plane; or inflate a first wrist pneumatic muscle component 22 and a fourth wrist pneumatic muscle component 24 in a fourth plane, and deflate a second wrist pneumatic muscle component 23 and a third wrist pneumatic muscle component 24 in a second plane to control a wrist to move into the fourth plane; or deflate a first wrist pneumatic muscle component 22 and a fourth wrist pneumatic muscle component 25 in a fourth plane, and inflate a second wrist pneumatic muscle component 23 and a third wrist pneumatic muscle component 24 in a second plane to control a wrist to move into the second plane.

Evidently those skilled in the art can make various modifications and variations to the disclosure without departing from the spirit and scope of this disclosure. Thus the disclosure is also intended to encompass these modifications and variations thereto so long as the modifications and variations come into the scope of the claims appended to the disclosure and their equivalents.

The invention claimed is:

1. A hand rehabilitation device, comprising a hand rehabilitation component, wherein the hand rehabilitation component comprises:

a glove;

a hand pneumatic muscle group comprising at least one finger pneumatic muscle component, wherein a back of each finger sleeve in the glove is installed with at least one of the at least one finger pneumatic muscle component; and a stopper which is connected with each finger sleeve and a side of each of the at least one finger pneumatic muscle component facing a corresponding finger sleeve.

2. The hand rehabilitation device according to claim 1, wherein the stopper comprises a limit line configured to stop a side of each of the at least one finger pneumatic muscle component facing each finger sleeve from extending in its axial directions while each of the at least one finger pneumatic muscle component is being inflated, wherein a plurality of knots are formed by the limit line and each finger sleeve.

3. The hand rehabilitation device according to claim 1, wherein the hand rehabilitation component further comprises a first control circuit configured to control each of the at least one finger pneumatic muscle component independently.

4. The hand rehabilitation device according to claim 1, further comprising:

a forearm sleeve connected with the glove;

a wrist pneumatic muscle group which is contractile and arranged around the forearm sleeve, wherein the wrist pneumatic muscle group comprises a plurality of wrist pneumatic muscle components;

a bracket configured to fix the wrist pneumatic muscle group in position; and a control circuit configured to control each of the plurality of wrist pneumatic muscle components to control a state of the wrist pneumatic muscle group.

5. The hand rehabilitation device according to claim 4, wherein the wrist pneumatic muscle group comprises a first wrist pneumatic muscle component, a second wrist pneumatic muscle component, a third wrist pneumatic muscle component, and a fourth wrist pneumatic muscle component;

wherein the first wrist pneumatic muscle component and the second wrist pneumatic muscle component lie in a first plane, the second wrist pneumatic muscle component and the third wrist pneumatic muscle component lie in a second plane, the third wrist pneumatic muscle component and the fourth wrist pneumatic muscle component lie in a third plane, and the fourth wrist pneumatic muscle component and the first wrist pneumatic muscle component lie in a fourth plane; the first plane is parallel to the third plane, and the second plane is parallel to the fourth plane; and wrist pneumatic muscle components in the first plane, and wrist pneumatic muscle components in the third plane form an antagonism mechanism, and wrist pneumatic muscle components in the second plane, and wrist pneumatic muscle components in the fourth plane form an antagonism mechanism.

6. The hand rehabilitation device according to claim 4, wherein the bracket comprises an annular first bracket and an annular second bracket arranged opposite to each other, and an annular forearm sheath arranged in the second bracket to fix the forearm sleeve in position, wherein:

the forearm sheath is adjustable in a radial direction of the second bracket, and two ends of each wrist pneumatic muscle component are fixed respectively on the first bracket and the second bracket.

7. The hand rehabilitation device according to claim 6, wherein the forearm sheath is connected with the second bracket through a plurality of springs.

8. The hand rehabilitation device according to claim 4, wherein the bracket comprises an annular first bracket and an annular second bracket arranged opposite to each other, and an annular forearm sheath arranged in the second bracket to fix the forearm sleeve in position, wherein:

a diameter of the forearm sheath is adjustable, and two ends of each wrist pneumatic muscle component are fixed respectively on the first bracket and the second bracket.

9. The hand rehabilitation device according to claim 6, further comprising a fixing component, wherein the fixing component comprises a fixing stand arranged on a palm section of the glove, a bottom fixing bracket arranged on a side of the fixing stand facing away from the palm section, and a side fixing bracket arranged on a side of the fixing stand; and the hand rehabilitation device is removably connected with the first bracket through the bottom fixing bracket and the side fixing bracket.

10. The hand rehabilitation device according to claim 8, further comprising a fixing component, wherein the fixing component comprises a fixing stand arranged on a palm section of the glove, a bottom fixing bracket arranged on a side of the fixing stand facing away from the palm section, and a side fixing bracket arranged on a side of the fixing stand; and the hand rehabilitation device is removably connected with the first bracket through the bottom fixing bracket and the side fixing bracket.

11. The hand rehabilitation device according to claim 1, wherein each of the at least one finger pneumatic muscle component comprises a flexible tube, and a woven mesh located on an outer side of the flexible tube, wherein:

in each of the at least one finger pneumatic muscle component, an angle between a fiber direction of the woven mesh located on the outer side of the flexible tube, and an axial direction of the flexible tube is greater than 57.4°.

12. The hand rehabilitation device according to claim 4, wherein the plurality of wrist pneumatic muscle components each comprises a flexible tube, and a woven mesh located on an outer side of the flexible tube, wherein:

in each of the plurality of wrist pneumatic muscle components, an angle between a fiber direction of the woven mesh located on the outer side of the flexible tube, and an axial direction of the flexible tube is less than 57.4°.

13. A rehabilitation training device, comprising a hand rehabilitation device, wherein the hand rehabilitation device comprises a hand rehabilitation component comprising:

a glove;

a hand pneumatic muscle group comprising at least one finger pneumatic muscle component, wherein a back of each finger sleeve in the glove is installed with at least one of the at least one finger pneumatic muscle component; and a stopper which is connected with each finger sleeve and a side of each of the at least one finger pneumatic muscle component facing a corresponding finger sleeve.

14. The rehabilitation training device according to claim 13, wherein the stopper comprises a limit line configured to stop a side of each of the at least one finger pneumatic muscle component facing each finger sleeve from extending in its axial directions while each of the at least one finger pneumatic muscle component is being inflated, wherein a plurality of knots are formed by the limit line and each finger sleeve.

15. The rehabilitation training device according to claim 13, wherein the hand rehabilitation component further comprises a control circuit configured to control each of the at least one finger pneumatic muscle component independently.

16. The rehabilitation training device according to claim 13, wherein the hand rehabilitation device further comprises a wrist rehabilitation component comprising:

a forearm sleeve connected with the glove;

a wrist pneumatic muscle group which is contractile and arranged around the forearm sleeve, wherein the wrist pneumatic muscle group comprises a plurality of wrist pneumatic muscle components;

a bracket configured to fix the wrist pneumatic muscle group in position; and a control circuit configured to control each of the plurality of wrist pneumatic muscle components to control a state of the wrist pneumatic muscle group.

17. The rehabilitation training device according to claim 16, wherein the wrist pneumatic muscle group comprises a first wrist pneumatic muscle component, a second wrist pneumatic muscle component, a third wrist pneumatic muscle component, and a fourth wrist pneumatic muscle component;

wherein the first wrist pneumatic muscle component and the second wrist pneumatic muscle component lie in a first plane, the second wrist pneumatic muscle component and the third wrist pneumatic muscle component lie in a second plane, the third wrist pneumatic muscle component and the fourth wrist pneumatic muscle component lie in a third plane, and the fourth wrist pneumatic muscle component and the first wrist pneumatic muscle component lie in a fourth plane; the first plane is parallel to the third plane, and the second plane is parallel to the fourth plane; and wrist pneumatic muscle components in the first plane, and wrist pneumatic muscle components in the third plane form an antagonism mechanism, and wrist pneumatic muscle components in the second plane, and wrist pneumatic muscle components in the fourth plane form an antagonism mechanism.

18. A method for controlling the rehabilitation training device according to claim 13, comprising:

inflate one of the at least one finger pneumatic muscle component in the hand pneumatic muscle group so that the one finger pneumatic muscle component control a corresponding finger sleeve to be bent; and/or, deflate one of the at least one finger pneumatic muscle component in the hand pneumatic muscle group so that a corresponding finger sleeve stretches straightly.

19. A method for controlling the rehabilitation training device according to claim 17, comprising an operation of controlling an action of the hand rehabilitation component and an operation of controlling an action of the wrist rehabilitation component;

wherein in the operation of controlling the action of the hand rehabilitation component:

inflate one of the at least one finger pneumatic muscle component in the hand pneumatic muscle group so that the one finger pneumatic muscle component control a corresponding finger sleeve to be bent; and/or, deflate one of the at least one finger pneumatic muscle component in the hand pneumatic muscle group so that a corresponding finger sleeve stretches straightly;

wherein in the operation of controlling the action of the wrist rehabilitation component:

inflate the first wrist pneumatic muscle component and the second wrist pneumatic muscle component in the first plane, and deflate the third wrist pneumatic muscle component and the fourth wrist pneumatic muscle component in the third plane to control a wrist to move into the first plane; or deflate the first wrist pneumatic muscle component and the second wrist pneumatic muscle component in the first plane, and inflate the third wrist pneumatic muscle component and the fourth wrist pneumatic muscle component in the third plane to control a wrist to move into the third plane; or inflate the first wrist pneumatic muscle component and the fourth wrist pneumatic muscle component in the fourth plane, and deflate the second wrist pneumatic muscle component and the third wrist pneumatic muscle component in the second plane to control a wrist to move into the fourth plane; or deflate the first wrist pneumatic muscle component and the fourth wrist pneumatic muscle component in the fourth plane, and inflate the second wrist pneumatic muscle component and the third wrist pneumatic muscle component in the second plane to control a wrist to move into the second plane.

* * * * *